US006685528B1

(12) United States Patent
Harvey

(10) Patent No.: US 6,685,528 B1
(45) Date of Patent: Feb. 3, 2004

(54) FLYABLE PLASTIC AIRPLANE AND METHOD OF MANUFACTURE

(76) Inventor: William B. Harvey, 4232 Stafford Rd., Olney, MD (US) 20832

( * ) Notice: Subject to any disclaimer, the term of this patent is extended or adjusted under 35 U.S.C. 154(b) by 0 days.

(21) Appl. No.: 09/962,534

(22) Filed: Sep. 25, 2001

Related U.S. Application Data

(60) Provisional application No. 60/237,109, filed on Sep. 29, 2000.

(51) Int. Cl.[7] ..... A63H 27/00

(52) U.S. Cl. ..... 446/61; 446/57

(58) Field of Search ..... 446/61, 62, 66, 446/67, 34, 87, 88, 487, 488; 244/120, 123, 124

(56) References Cited

U.S. PATENT DOCUMENTS

| | | | | | |
|---|---|---|---|---|---|
| 2,347,561 | A | * | 4/1944 | Howard et al. | 434/372 |
| 2,555,670 | A | * | 6/1951 | Babcock | 446/88 |
| 2,870,567 | A | * | 1/1959 | Bergstrand | 446/34 |
| 2,920,682 | A | * | 1/1960 | Lindberg | 156/91 |
| 3,963,554 | A | * | 6/1976 | Sigafoose | 156/304.2 |

* cited by examiner

*Primary Examiner*—Derris H. Banks
*Assistant Examiner*—Bena B. Miller
(74) *Attorney, Agent, or Firm*—Zito tlp; Joseph J. Zito; Kendal M. Sheets

(57) ABSTRACT

A ready to fly airplane formed from plastic with an upper portion and a lower portion which are joined together and covered with a thin film. Supporting structure is formed within the upper portion and the lower portion. The horizontal tail surfaces may pivot about a horizontal plane when controlled by an external control. A method of manufacture is described.

13 Claims, 9 Drawing Sheets

FLYABLE PLASTIC AIRPLANE AND METHOD OF MANUFACTURE

CROSS REFERENCE TO RELATED APPLICATION

The present invention is related to Provisional Patent Application No. 60/237,109 filed Sep. 29, 2000.

BACKGROUND OF THE INVENTION

1. Field of the Invention

The present invention is directed to flyable airplanes and, more particularly, to airplanes which are formed from plastic and the method of manufacturing the plastic airplanes.

2. Description of Related Art

Ready to fly control line models are well known in the art and generally consist of injection molded plastic components that are quickly assembled by the end user. Models built this way are relatively heavy for their size and have high wing loading compared to hand built models. A company that produces such models is Estes Industries, producing a line of models under the COX brand name. Prior models have been built with the wing and fuselage made from vacuum-formed shells, but no attempt to build in an internal structure as in ribs or spars as been employed. Further, no prior manufacturer of control line flying models has incorporated all the functioning parts including the wing, the fuselage, the vertical fin, and the moving tail surface into two halves or "shells". Other types of ready to fly models have been molded from steam expanded and other structural foams, from pre-printed laminated foam sheet that is wrapped around a balsa wood structure, an assembly of vacuum formed components, and from a combination of fiberglass and hot wire cut plastic foam. Such models require extensive hand labor to complete and cannot be easily mass produced.

There is, therefore, no method of fabrication known in the prior art that utilizes two portions or shells to produce the entire airframe or that will produce a ready to fly model airplane that exhibits an internal structure and allows assembly of the entire airframe in a single operation. There is no control line model in the prior art that can be mass produced as simply or efficiently as the method herein, and, owing to a covering of self adhesive vinyl or other thin material, appear to have been built by the time consuming hand method of fabrication using a hand built balsa wood internal structure.

BRIEF SUMMARY OF THE INVENTION

It is a primary object of the present invention to provide a robust airplane that can be efficiently mass-produced in a variety of color schemes and have the appearance and performance of a hand built model.

It is another object of the present invention to provide a lightweight aircraft that will be easy to fly and withstand abuse from a beginner in the sport.

It is another object of the present invention to provide a method of manufacturing that can be easily tooled to produce a variety of styles and specific types of airplanes that employ a variety of airfoil shapes and contours.

It is another object of the present invention to minimize the assembly time that the end user must spend prior to flight.

It is another object of the invention to provide an efficient method of manufacturing a full flying horizontal tail surface or "stabilator".

In accordance with the teachings of the present invention, there is disclosed a method of fabricating a ready to fly plastic airplane. An upper portion of the airplane is formed having an upper wing, an upper fuselage portion, a vertical tail fin, and a pair of upper horizontal tail surfaces, one on each side of the first fuselage portion. A lower portion of the airplane is formed having a lower wing, a lower fuselage portion, and a pair of lower horizontal tail surfaces, one on each side of the second fuselage portion. The upper portion is joined to the lower portion. Excess material is trimmed around a periphery of the joined portions. The joined horizontal tail surfaces are separated from the fuselage. A bearing is mounted on each side of the fuselage where the horizontal tail surfaces had been joined. The horizontal tail surfaces are reconnected to a respective bearing wherein each horizontal tail surface may pivot on opposite sides of the fuselage about a horizontal plane, connecting the horizontal tail surfaces to a control rod wherein movement of the control rod may produce pivotal movement of the horizontal tail surfaces, mounting a motor driven propeller on the fuselage forward of the wings, mounting a landing gear on the fuselage, covering the formed airplane with a thin film.

In further accordance with the teachings of the present invention, there is disclosed a ready to fly plastic airplane. The airplane has a fuselage, a pair of wings, one on each side of the fuselage, a vertical tail fin and a pair of horizontal tail surfaces, one on each side of the fuselage, an engine mounted on the fuselage, a propeller driven by the engine and a landing gear connected to the fuselage. The fuselage, wings tail fin and horizontal tail surfaces being formed from an upper portion and a lower portion which are joined together. A thin film covers the airplane. Control means are connected to the airplane for external control of the flight of the airplane.

These and other objects of the present invention will become apparent from a reading of the following specification taken in conjunction with the enclosed drawings.

DESCRIPTION OF THE PREFERRED EMBODIMENTS

Figure 1:
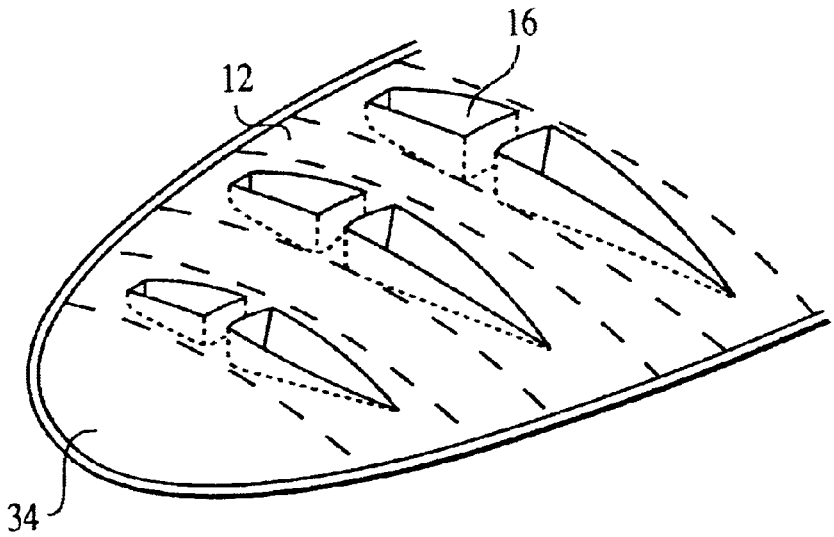
FIG. 1 is a perspective view of a part of the upper portion of one embodiment of the wing.
Figure 2:
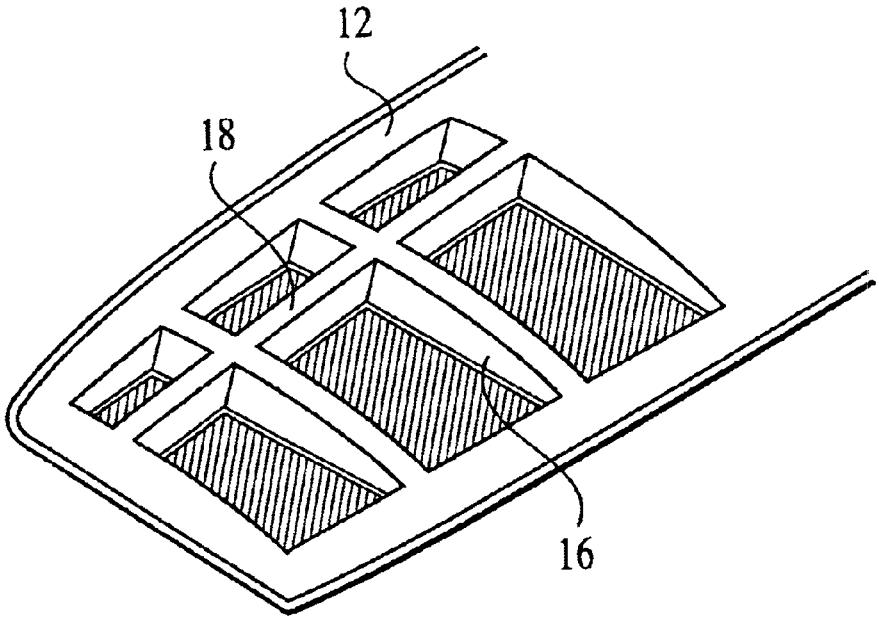
FIG. 2 is a perspective view of a part of the upper portion of another embodiment of the wing.
Figure 3:
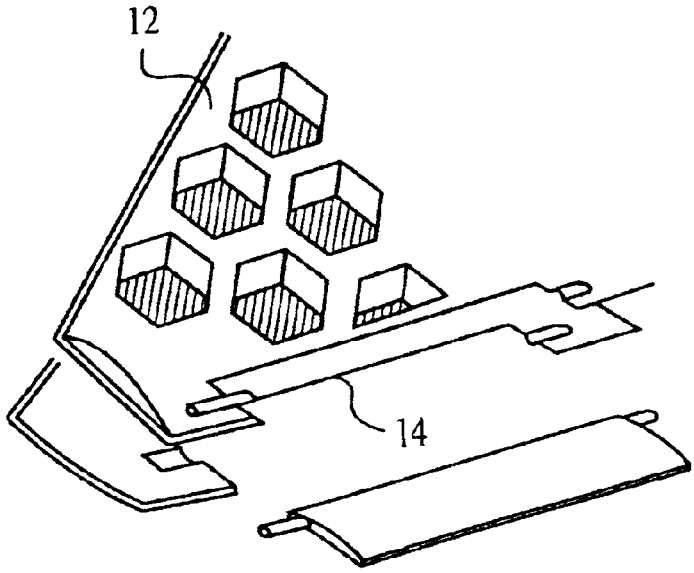
FIG. 3 is a perspective view of a part of the upper portion of a delta wing showing a movable elevator surface.
Figure 4:
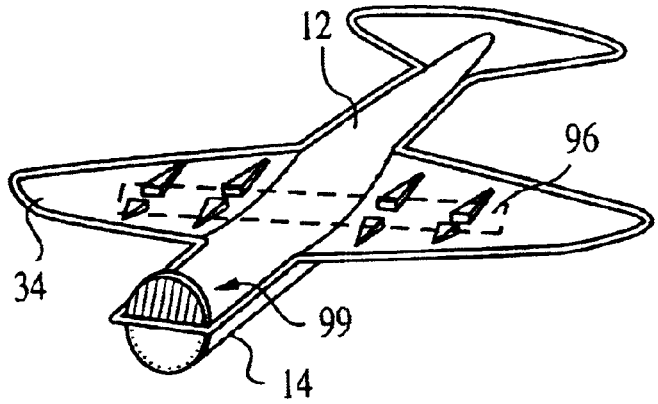
FIG. 4 is a perspective view showing the upper portion being joined to the lower portion.
Figure 5:
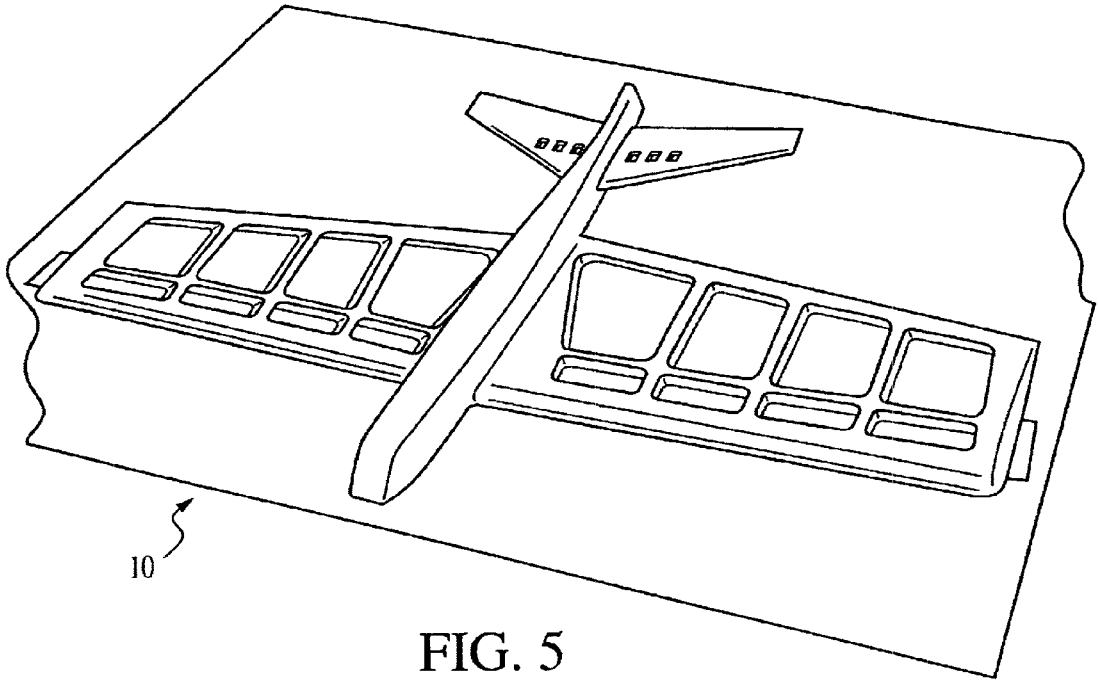
FIG. 5 is an airplane with the upper and lower portions joined before the excess is trimmed and covered.
Figure 6:
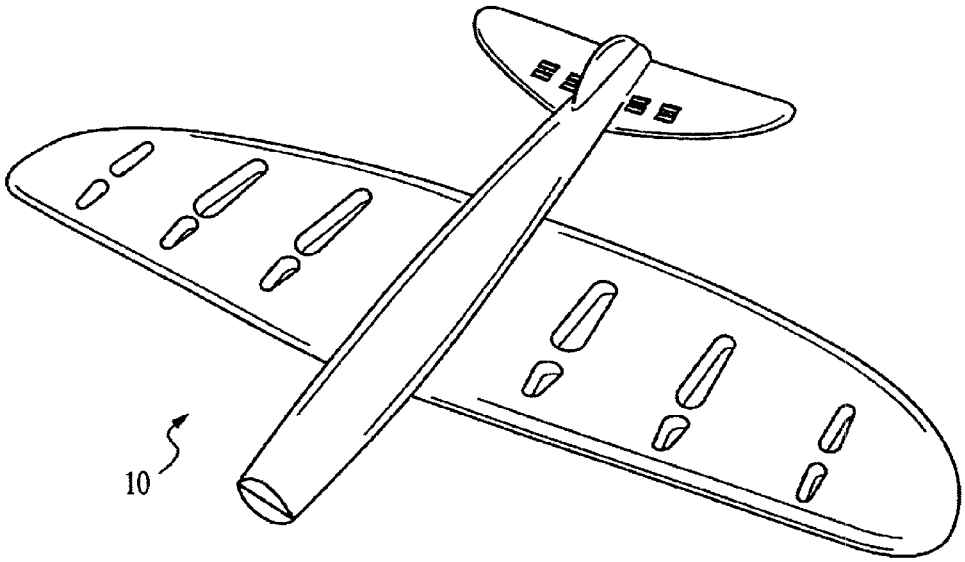
FIG. 6 is a perspective view of a different design airplane which has been trimmed prior to separating the horizontal tail surfaces.
Figure 7:
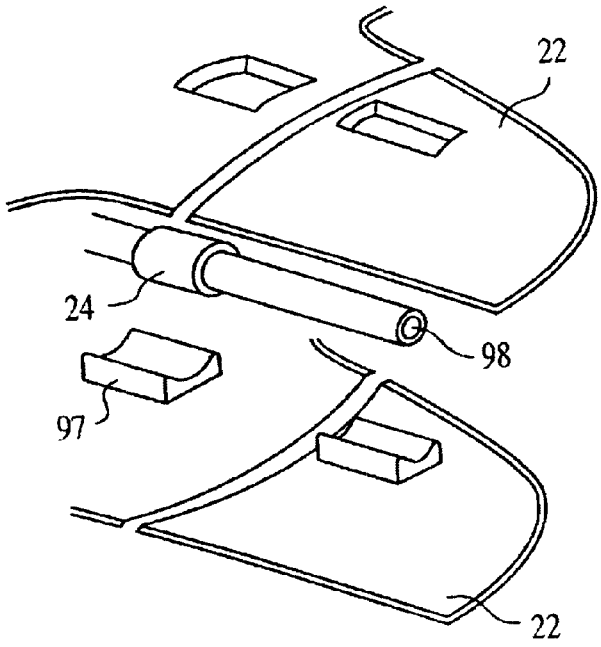
FIG. 7 is a schematic view showing the assemblage of the pivotable horizontal tail surfaces.
Figure 8:
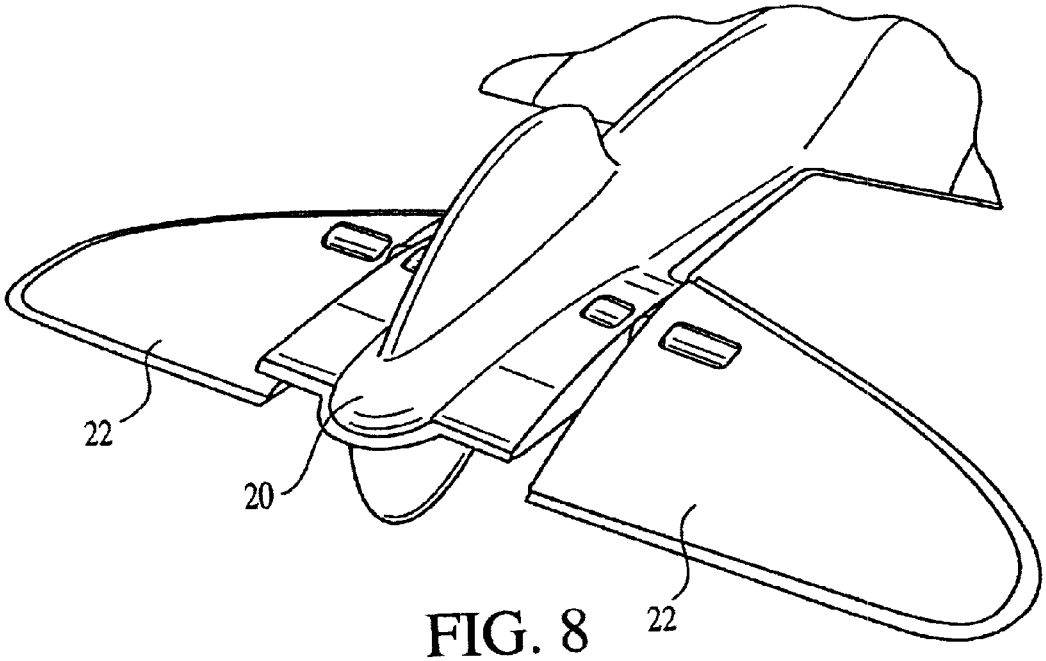
FIG. 8 is a perspective view of the tail section of an airplane showing the movable horizontal tail surfaces and a film over the wings.
Figure 9:
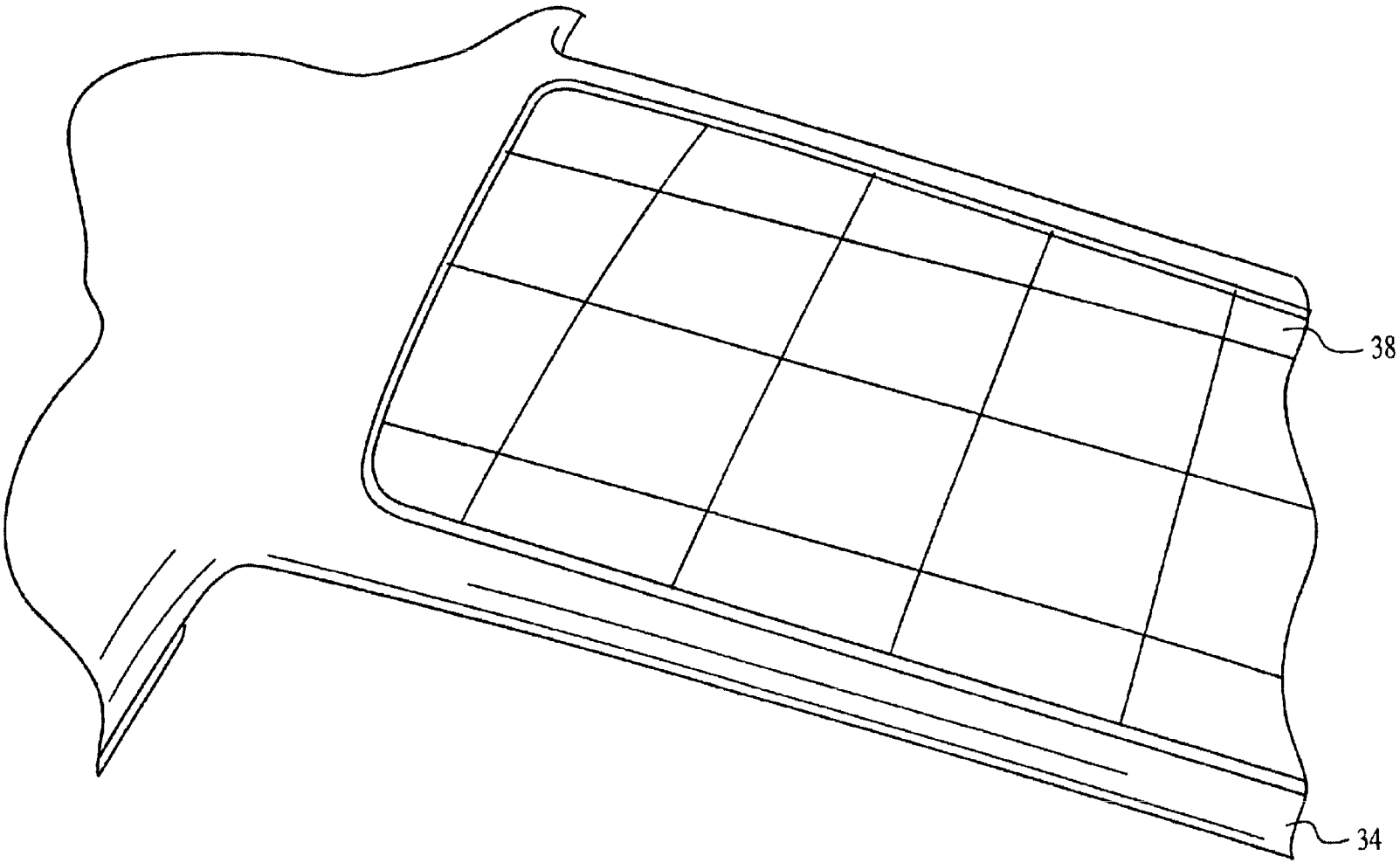
FIG. 9 is an enlarged perspective view showing pressure sensitive film over a wing.
Figure 10:
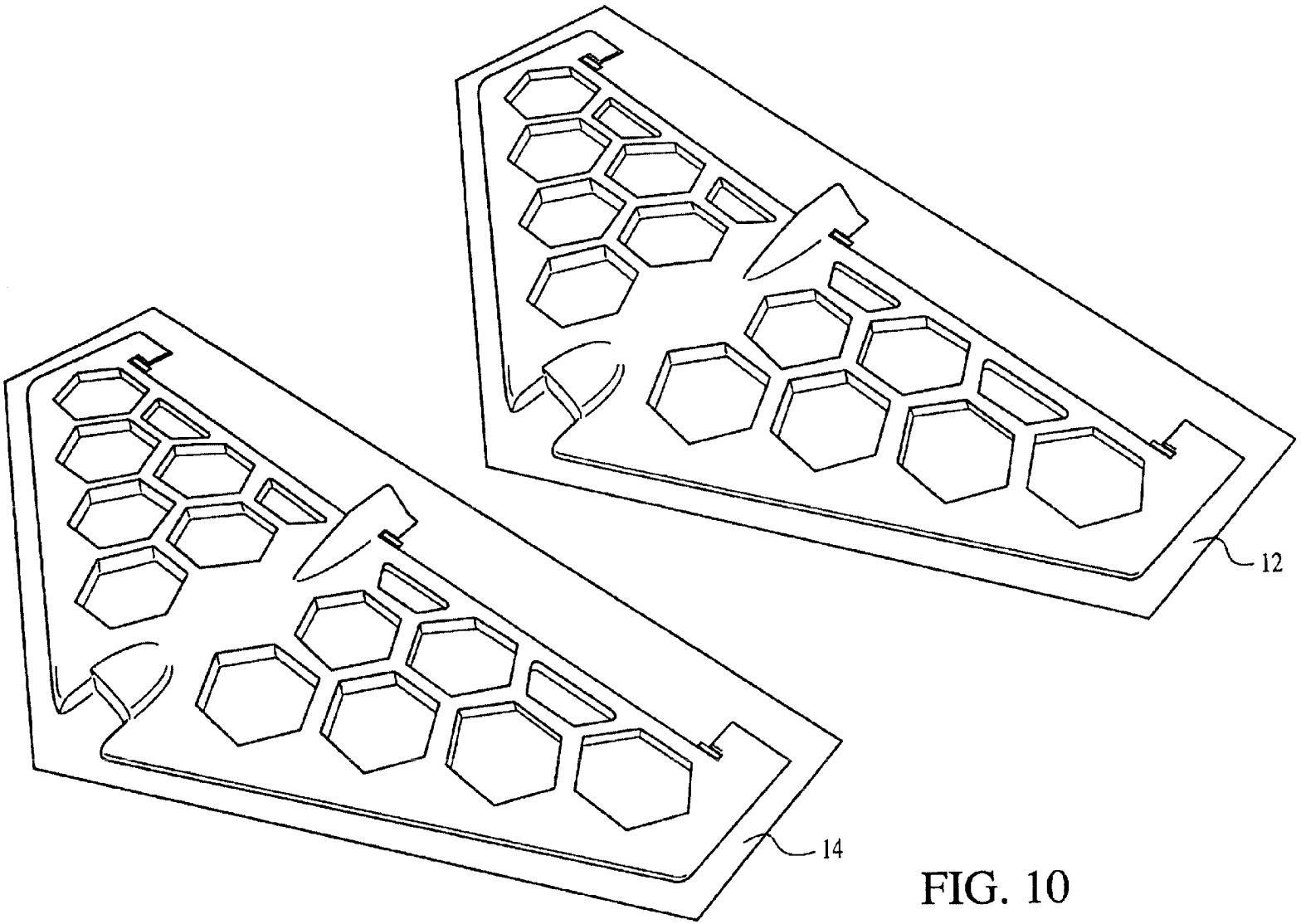
FIG. 10 is a perspective view showing formed upper and lower portions of a delta wing airplane.

The method of fabricating a ready to fly airplane 10 comprises the steps of forming two portions of the airplane consisting of an upper portion 12 and a lower portion 14. Preferably, the portions are vacuum-formed over a pattern, but other methods of forming may be used. When the portions are joined by adhesive, ultrasonic sealing, heating of the periphery of the portions or other means known to persons skilled in the art, any excess material around the periphery is trimmed. The upper and lower portions have the following features:

1) Left and right wing sections 34 with an internal wing structure such as ribs 16 and spars 18 formed into each portion, which after the joining of the portions together to form the left and right wings, provide strength to accommodate aerodynamic loads encountered in flight. These structures can include a variety of shapes, including a hexagon configuration.
2) Vertical fins 20, which can be composed of a shape on one or both of the portions, such that when the portions are joined together provides yaw stability to the airplane.
3) Fuselage sections 32 that after joining the upper and lower portions together to form the fuselage will accommodate motor and landing gear attachment. A firewall 99 is inserted into the front of one of the fuselage sections rearward of the motor mounting location prior to joining the portions together.
4) Left and right horizontal tail sections 22. The horizontal tail sections are formed integrally with the upper and lower portions of the airplane and after joining the two portions, a control section of each of the completed left and right horizontal tail surfaces which, in the exemplary embodiment, can encompass the entire horizontal tail surface, are separated from the assembly and reconnected via a pivot tube 98 and bearing mount 97 installed through each side of the fuselage. In this manner, the control sections of the horizontal tail surfaces move pivotally on opposite sides of the fuselage about a horizontal axis to provide pitch or "up and down control to the airplane".
5) A surface for application of pressure sensitive film 38 or skin to provide wing covering as well as cosmetic decoration. The film may be vinyl or other materials known to persons skilled in the art.
6) An internal structure to accommodate a reinforcing spar 96 inserted into the structure prior to joining the portions that also serves as the bellcrank or linkage mount on the airplane.
7) Control means such as a) control lines connected to the airplane or b) a radio receiver mounted in the airplane with a radio transmitter held by an operator. In this manner, the airplane can be controlled externally of the airplane. The present invention is applicable to model airplanes and unmanned aerial vehicles (UAV). A bellcrank 95 and leadout guide 94 or radio controlled, motorized controller of any type known to persons skilled in the art with linkage via a push/pull rod 93 and a control horn 92 to the horizontal tail surfaces.
8) Control means such as control lines 40 connected to the bellcrank through the leadout guide or a radio receiver mounted in the airplane connected to the motorized controller and a radio transmitter held by an operator. In this manner, the airplane can be controlled externally of the airplane. The present invention is applicable to model airplanes and unmanned aerial vehicles (UAV).

Preferably, the plastic from which the airplane is formed has a thickness of approximately 0.010–0.015 inches.

The ready to fly plastic airplane 10 is made by forming an upper portion 12 of the airplane having upper left and right wing sections, an upper fuselage section 32, a vertical tail fin 20, and upper left and right horizontal tail sections, one on each side of the upper fuselage section. A lower portion 14 of the airplane 10 is formed having lower left and right wing sections, a lower fuselage section, and lower left and right horizontal tail sections, one on each side of the lower fuselage section. The upper portions 12 is joined to the lower portion 14. Excess material is trimmed from around the periphery of the joined portions 12, 14. The control sections of the joined left and right horizontal tail surfaces 22 are separated from the fuselage. A pivot tube 98 with bearing 24 is mounted on each side of the fuselage where the control sections of the horizontal tail surfaces 22 had been joined. The control sections of the horizontal tail surfaces 22 are reconnected to the airplane on respective sides at pivot tube 98 wherein the control sections of each horizontal tail surface 22 may pivot on opposite sides of the fuselage about a horizontal axis. The control sections of the horizontal tail surfaces 22 are connected to a push/pull rod 93 through a control horn 92 attached to pivot tube 98 wherein movement of the push/pull rod 93 may produce pivotal movement of the control sections of the horizontal tail surfaces 22.

A motor 28 driven propeller 30 is mounted on the fuselage forward of the wings. A landing gear 36 is mounted on the fuselage. The formed airplane 10 is covered with a thin film 38. The covering may be a vinyl film or other films known to persons skilled in the art.

Figure 11:
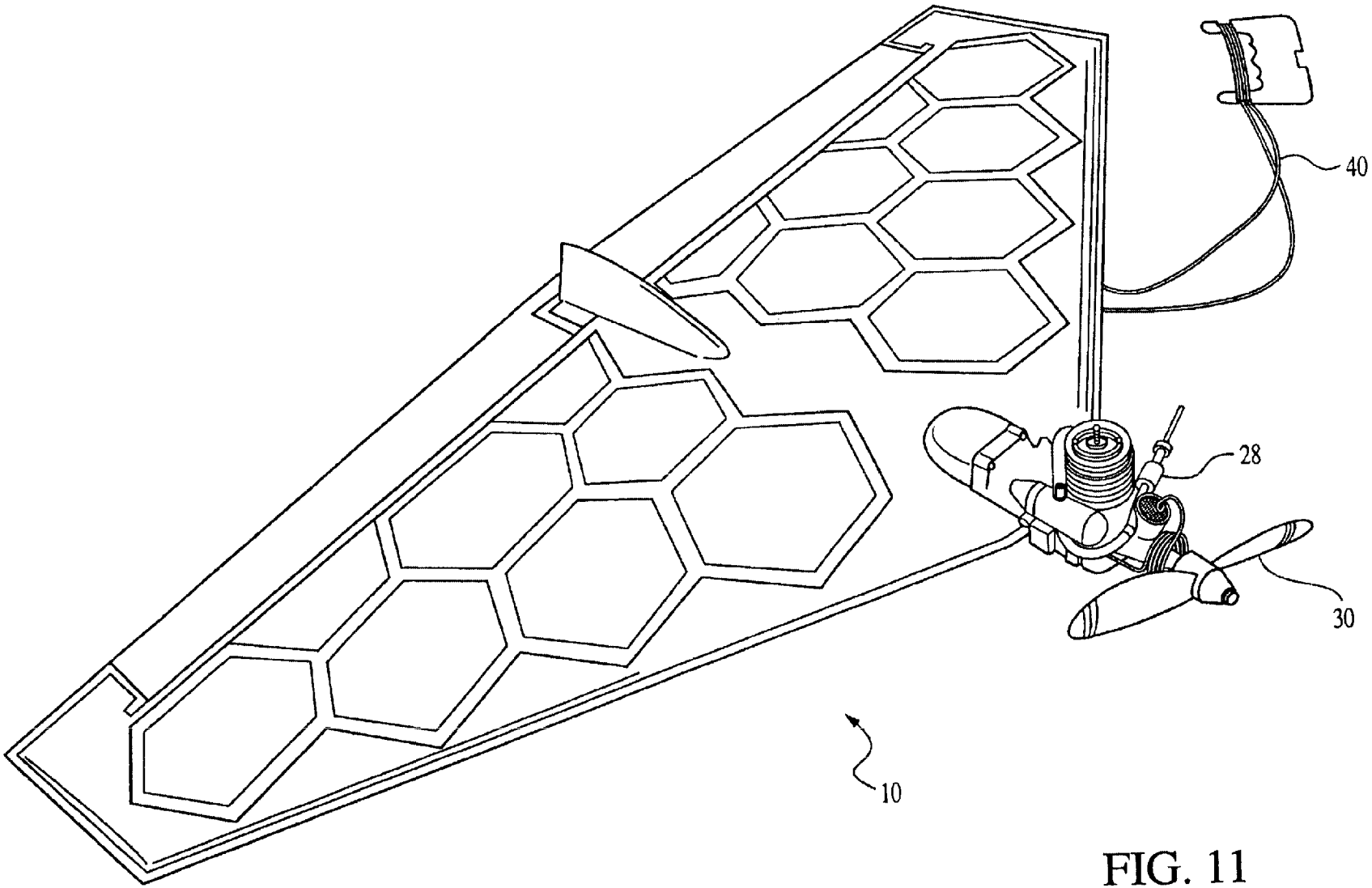
FIG. 11 is a perspective view showing an assembled delta wing airplane with film covering, a mounted motor and propeller and control line.
Figure 12:
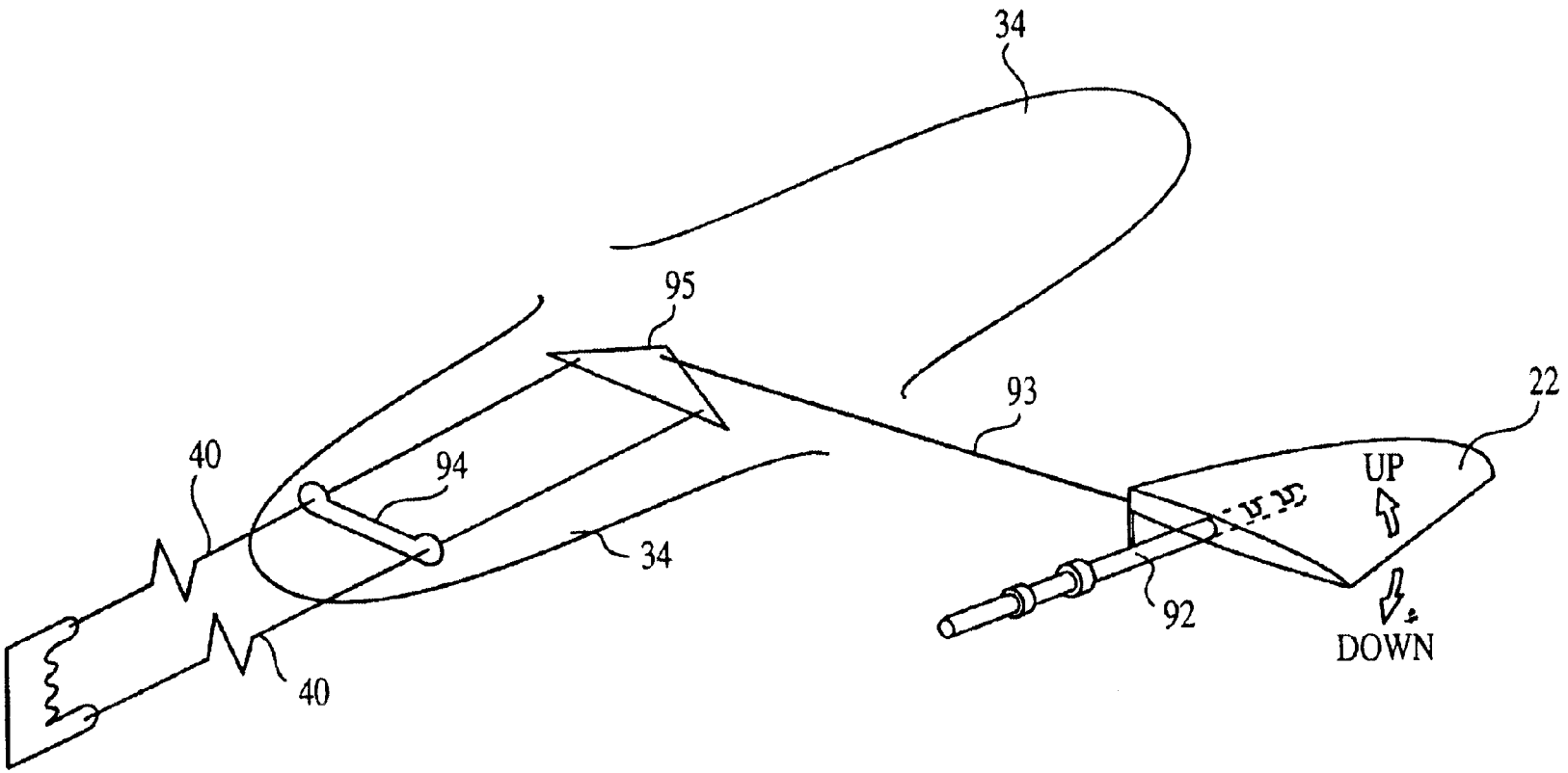
FIG. 12 is a schematic drawing showing the control line connected to the airplane.
Figure 13:
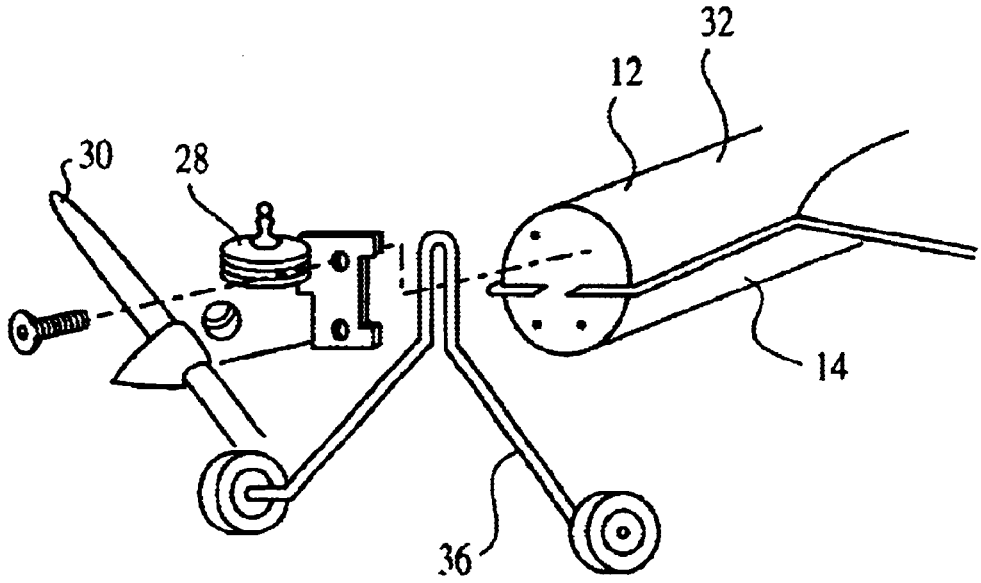
FIG. 13 is a schematic drawing showing the motor, propeller and landing gear mounted on the fuselage.
Figure 14:
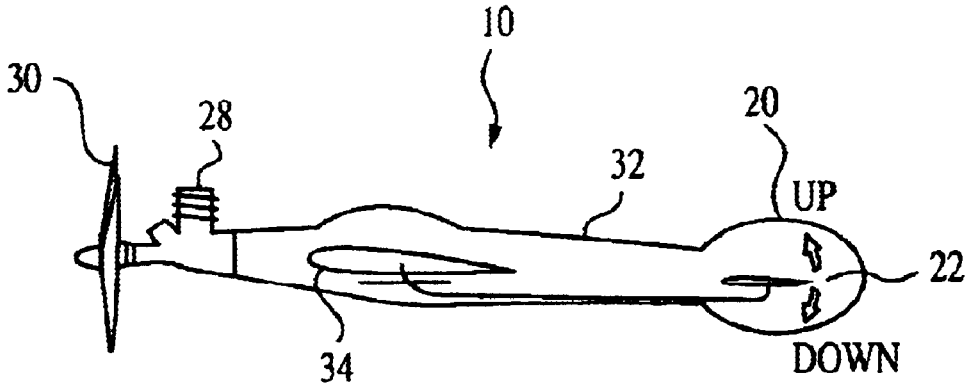
FIG. 14 is a side elevation view of an airplane showing pivotal movement of the horizontal tail surfaces.

Each formed portion of the airplane has internal ribs 16 and spars 18 to provide mechanical support. A separate reinforcing spar 96 is inserted into the wing section of one of the portions before joining the portions. The vertical tail fin 20 formed on the upper portion 12 and/or lower portion 14 improves yaw stability. In an exemplary embodiment, the lower wing section is formed symmetrical to the upper wing section such that wing loading is minimized and the airplane can be made to perform aerobatic maneuvers. The upper and lower portions of the airplane may have a delta shape and the airplane may be a delta wing airplane as shown in FIG. 11 having improved maneuverability. Control lines 40 are connected via a bellcrank 95 to the control rod 93 wherein pivoting of the left and right horizontal tail surfaces may be controlled externally of the airplane 10. A receiver for radio control signals and an appropriate servo mechanism as is well known on the art, may be mounted on the fuselage wherein the airplane may be radio controlled.

As shown in FIGS. 5–10, airplanes of various designs can be made in accordance with the present invention. The wings may be formed in the traditional air foil shape or the upper surface of each wing may be symmetrical with the lower surface so the corresponding wing such that wing loading is minimized and the airplane can be made to perform acrobatic maneuvers.

The present application is for model airplanes and for unmanned aerial vehicles (UAV).

The film covering the airplane may have any desired pattern, design or color.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method of fabricating a ready to fly plastic airplane comprising the steps of:

forming a first portion of the airplane having a first fuselage section, left and right wing sections connected to said first fuselage section, and left and right horizontal tail sections connected to said first fuselage section, forming a second portion of the airplane having a second fuselage section, left and right wing sections connected to said second fuselage section, and left and right horizontal tail sections connected to said second fuselage section, joining said first and second portions to create a wing and fuselage assembly with left and right horizontal tail surfaces, trimming excess material around a periphery of said joined portions, separating said left and right horizontal tail surfaces from said fuselage, mounting a pivot tube with bearings and control horn through each side of the fuselage where the horizontal tail surfaces had been attached, reconnecting the horizontal tail surfaces to their respective sides of said fuselage, wherein each horizontal tail surface may pivot on opposite sides of said fuselage about a horizontal axis, connecting said horizontal tail surfaces to a control means to produce pivotal movement of said horizontal tail surfaces, mounting a motor driven propeller on the fuselage forward of the wings, mounting a landing gear on the fuselage, covering at least a portion of the airfoil surfaces of said formed airplane with a thin film material.

2. The method of claim 1, wherein each portion of the airplane has internal ribs and spars to provide mechanical support.

3. The method of claim 1, further comprising inserting a reinforcing spar into the wing section of one of the portions before joining the portions.

4. The method of claim 1, further comprising forming a vertical tail fin on the upper and/or lower portion to improve yaw stability of the airplane.

5. The method of claim 1, further comprising connecting control lines to the said control means wherein pivoting of the horizontal tail surfaces may be controlled externally of the airplane.

6. The method of claim 1, further comprising a receiver for radio control signals connected to said control means, mounted on the fuselage wherein the airplane may be radio controlled.

7. The method of claim 1, wherein the upper portion is joined to the lower portion by adhesive.

8. The method of claim 1, wherein the upper portion is joined to the lower portion by ultrasonic sealing.

9. The method of claim 1, wherein the upper portion is joined to the lower portion by heating the periphery of the upper and lower portions.

10. The method of claim 1, wherein the second wing section is formed symmetrical to the first wing section such that wing loading is minimized and the airplane can be made to perform acrobatic maneuvers.

11. The method of claim 1, wherein the upper portion and the lower portion have a delta shape and the airplane is a delta wing airplane having improved maneuverability.

12. The method of claim 1, wherein the covering is a vinyl film.

13. The method of claim 1, wherein said first and seconds portions of said airplane are vacuum formed.

* * * * *